US005732453A

United States Patent [19]

Dilo et al.

[11] Patent Number: 5,732,453

[45] Date of Patent: Mar. 31, 1998

[54] NEEDLE BAR DRIVING APPARATUS OF A NEEDLE LOOM

[75] Inventors: Johann Philipp Dilo; Joachim Leger, both of Eberbach, Germany

[73] Assignee: Oskar Dilo Maschinenfabrik KG, Eberbach, Germany

[21] Appl. No.: 699,881

[22] Filed: Aug. 15, 1996

[30] Foreign Application Priority Data

Sep. 15, 1995 [DE] Germany ..... 195 34 261.5
Apr. 19, 1996 [DE] Germany ..... 196 15 697.1

[51] Int. Cl.[6] ..... D04H 18/00

[52] U.S. Cl. ..... 28/114; 28/107

[58] Field of Search ..... 28/107, 111, 113, 28/114, 115; 112/80.4, 80.45, 80.42, 271

[56] References Cited

U.S. PATENT DOCUMENTS

| | | | |
|---|---|---|---|
| 4,035,881 | 7/1977 | Zocher | 28/115 |
| 4,241,479 | 12/1980 | Dilo | 28/107 |
| 4,891,870 | 1/1990 | Muller | 28/107 |
| 5,511,294 | 4/1996 | Fehrer | 28/107 |
| 5,548,881 | 8/1996 | Ludwig | 28/114 |

*Primary Examiner*—C. D. Crowder
*Assistant Examiner*—Larry D. Worrell, Jr.
*Attorney, Agent, or Firm*—Ostrolenk, Faber, Gerb & Soffen, LLP

[57] ABSTRACT

In a needle loom for needling a fiber batt continuously moved through the needle loom, a horizontal driving apparatus connected to a needle bar for horizontally driving said needle bar to and fro is provided which is driven in synchronism with a vertical driving apparatus providing the needle bar with a reciprocating up and down movement by which needles affixed to the needle bar are stitched into the fiber batt to be needled. The timing of the horizontal and vertical movements imposed onto the needle bar is adjusted in a manner that the needle bar horizontally follows the movement of the fiber batt when the needles are stitched in the fiber batt, whereas in the horizontal return stroke of the needle bar its needles are out of the fiber batt. In a double needle loom in which needles are disposed at two needle bars provided on either side of the fiber batt so that needles are stitched into the fiber batt on either side thereof, each needle bar is provided with its own horizontal drive, elements are provided for preventing a collision of needles when stitched into the fiber batt.

20 Claims, 7 Drawing Sheets

NEEDLE BAR DRIVING APPARATUS OF A NEEDLE LOOM

BACKGROUND OF THE INVENTION

The present invention refers to a needle bar drive of a needle loom for processing a fiber batt, having at least a first crank drive for generating a first reciprocating movement of an associated needle bar, said first reciprocating movement substantially extending perpendicularly to the fiber batt to be processed, and having a guide means which laterally guides the needle bar on its reciprocating path. A drive of this kind is known from U.S. Pat. No. 2,241,479 to Dilo.

The above-mentioned reference describes a drive for the needle bar of a needle loom, in which the needle bar is guided on both sides transversely to the feed direction of the fiber batt to be needled by pivotally supported levers, which are coupled on one end at the needle bar and which have a tooth segment arc at the other end, the teeth of which meshing in a matching toothing at an opposite element attached at the loom frame. A vertical guide of the needle bar is achieved by this construction, said vertical guide not having sliding surfaces that are exposed to lateral forces caused by the crank drive of the needle bar.

From EP 0 013 902 B1 (U.S. Pat. No. 4,454,637) an arrangement is known for the friction-poor guide of a needle bar in the feed direction of a fiber batt to be needled, according to which wings are rigidly attached at the needle bar, extending transversely to this needle bar, i.e. in the feed direction of the fiber batt, said wings being pivotally supported at a shaft extending in approximately the same level as and in parallel to the needle bar. These wings are formed relatively long in order to achieve a straight movement of the needle bar during its reciprocating up and down movement.

During needling of a fiber batt, the needles attached at the needle bar provided with barbs penetrate that fiber batt located on a support below the needle bar and are withdrawn therefrom. The fiber batt is moved as a web through the needle loom. As long as the feed speed of the fiber batt is low compared to the frequency of the reciprocal movement of the needle bar, the motion stop of the fiber batt caused for a short period of time by the needles dipped into the fiber batt does not cause any problems. However, problems occur if it is desired to increase the fiber batt speed through the needle loom. The fiber batt can be moved out of shape by the needles pierced into the fiber batt and which do not follow the feed motion of the fiber batt, so that the needles are cyclically resiliently bent.

The object of the invention is to provide a drive of the above-mentioned kind which enables a high feed of the fiber batt per needle bar stroke.

SUMMARY OF THE INVENTION

This object is achieved by a needle bar drive of a needle loom for processing a fiber batt, which is moved by a conveying means in a predetermined feed direction through the needle loom, comprising at least one first crank drive for generating a first reciprocating movement of an associated needle bar, said reciprocating movement extending substantially vertically to the fiber batt to be processed, and a guide means which laterally guides the needle bar on its path of movement, wherein said guide means is formed by at least one second crank drive, which is driven in synchronism with the first crank drive and comprises at least one connecting rod attached to the needle bar, and providing said needle bar with a second reciprocating component extending parallel to the feed direction of the fiber batt.

The invention provides a drive in which additional connecting rods at a mutual distance are attached at the needle bar besides the connecting rods causing the (vertical) needle stitching movement of the needle bar, said additional connecting rods extending substantial parallel to the direction of feed of the fiber batt to be needled and are driven by a second crank drive synchronously to one another and provide the needle bar with a (horizontal) oscillating movement in and opposite to the direction of feed of the fiber batt (hereinafter abbreviated as fleece). The expressions "vertical" and "horizontal" mean in this case that the stitching movement of the needles usually extends vertically to the fleece in needle looms and that the fleece is usually moved horizontally through the loom. It is possible by the invention to provide the second crank drive with a relatively great stroke, the motion course of which being synchronized with the motion course caused by the first crank drive in a manner that the needle bar is moved with the fleece in the feed direction of the fleece at least in a section of the fleece motion during a state in which the needles are stitched into the fleece. Moving out of shape of the fleece caused by the needles or a resilient bending of the needles caused by the motion of the fleece is thus substantially prevented, and it is possible to considerably increase the fleece feed speed at a given vertical stroke frequency of the needle bar.

A needle loom with an additional movement of the needle bar in the horizontal direction is already known from DE-OS 1 803 342, in which the needle bar is guided by guide rods, by means of which the needle bar receives a movement in the fleece feed direction superimposed on the vertical movement of the needle bar. However, by the superimposed horizontal movement, the needles stitched into the fleece are to be moved within the stitching holes transversely to their vertical movement with respect to the fleece to artificially enlarge the stitching holes. For this purpose it is provided that the needles are driven horizontally at a double frequency with respect to the stitching frequency, which leads to the result that the horizontal movement of the needles is partially in opposite direction to the fleece feed direction. A further movement extending transversely to the fleece feed direction shall be superimposed on the needle bar movement by means of a further drive, so that the needles somehow stirr within their stitching holes. By this measure the fleece structure is—intentionally—severely deteriorated and the needles are strongly bent so that this known needle bar drive effects exactly the opposite of what is desired by the invention.

Needle looms usually have a twin drive as a first crank drive, i.e. two crank shafts driven in opposite directions and synchronous with one another are connected to a twin arrangement composed of two needle bars that are attached at a common truss or rigidly connected to one another in a different appropriate manner and are arranged behind one another in the fleece feed direction. Due to the opposite directions of the two crank drives, the connecting rods of the second crank drive have to be pivotally attached at the needle bar, since the horizontal movement of the needle bar caused by the second crank drive causes a forced but even small tilt movement during the reciprocal movement thereof.

If the first crank drive for the needle bar comprises one crank shaft only a twin arrangement having two second connecting rods with respective crank shafts are preferably provided which are disposed behind one another seen in the stroke direction of the first crank drive, i.e. disposed on top of each other in practical application—for generating the horizontal movement of the needle bar, wherein the second connecting rods are pivotally attached at the needle bar. Due to mutual mass balance, the crank shafts of the second connecting rods advantageously rotate in directions opposite to one another.

If the two crank shafts of the second crank drive thus, rotate in opposite directions, the needle bar performs a slight tilt movement in its reciprocal movement generated by the first crank drive, which provide the needle tips with an additional movement component extending parallel to the fleece feed direction, which superimposes on the horizontal movement caused by the second crank drive.

If the two crank drives of the second crank drive are moving in the same direction, the above-mentioned tilt movement is not existing, but special measures for the mass balance of the second crank drive are required, in particular by balance shafts, as is known per se in the art.

If the first crank drive only comprises one crank shaft only and if the connecting rods thereof are pivotally connected to the needle bar, the connecting rods of the second crank drive are rigidly connected to the needle bar in case the second needle bar drive contains one crank shaft only.

If the first crank drive comprises one crank shaft only and if the connecting rods thereof are rigidly connected to the needle bar, the connecting rods of the second crank drive are pivotally connected to the needle bar if the second crank drive contains one crank shaft only.

The stroke length of the second crank drive is adjustable preferably proportional to the stroke length of the first crank drive, so that long dwelling times of the needles in the fleece are taken into consideration by a respective increase of the feed movement of the needle bar with the fleece. It can also be provided to adjust the stroke length of the second crank drive independent of the first crank drive in order to take into consideration differences in the dwelling time of the needles in the fleece that are determined by the respective fleece thickness.

A double eccentric arrangement can be chosen for adjusting the stroke lengths of the second crank drive, in which an (outer) eccentric bushing is rotatably disposed on an (inner) eccentric pin which is fixedly connected to the crank shaft of this crank drive, but said (outer) eccentric bushing being adapted to be fixedly coupled to the eccentric pin in different mutual rotary positions, whereas the head of the connecting rod is rotatably guided on the eccentric bushing. The eccentricity of this eccentric arrangement depends on the eccentricities of eccentric pin and eccentric bushing, and can be adjusted after releasing the mutual coupling by rotating the eccentric bushing with respect to the eccentric pin. An alternative, constructively very simple solution is to replace the eccentric elements, in particular if only a small number of eccentric sizes is required and if modifications are to be performed very rarely.

The phase, i.e. the timing of the second crank drive is preferably adjustable with respect to the phase, i.e. the timing of the first crank drive. Thus, different stitching angles of the needles can be taken into consideration. In this art, the stitching angle is the rotary angle range of the crank shaft of the (first) crank drive providing the needle bar with the reciprocating movement, during which the needles are stitched into the fleece to be processed. Often this stitching angle is 180°, i.e. at a crank angle of 90° before top dead center (TDC), the needle tips penetrate the fleece and at a crank angle of 90° after bottom dead center (BDC) they leave the fleece. At these stitching angles the greatest force is acting on the needles during the moment of snitching in the needle tips into the fleece. According to the fleece material (kind of fiber, fleece thickness) different, in particular smaller stitching angles can be used, in particular a stitching angle of 90°, in which the needles penetrate into the fleece e.g. at a crank angle of 135° after TDC and leave the fleece at a crank angle of 45° after BDC. It is suitable in any case if the horizontal speed of the needle bar caused by the second crank drive during the moment of stitching in of the needle tips into the fleece substantially corresponds to the feed speed of the fleece through the needle loom to avoid bending of the needles during stitching in. Different stitching angles lead to different crank angles of the first crank drive during the time of penetration of the needle tips into the fleece, as described above, and the phase angle of the second crank drive with respect to the phase angle of the first crank drive shall be adaptable to these different crank angles to be able to adjust optimum relations.

In practical application, the needle loom has only one drive unit for the needle bar which drives both crank drives. An adjustment of the mutual phasing of the crank drives can be achieved in that an intermediate gearing having a releasable coupling unit is disposed in a power transmission path arranged between the drive unit and one of the crank drives, said coupling means allowing to couple a drive element and an output element at different mutual rotary positions. This may e.g. be a claw coupling or a flange coupling, or a toothed belt drive comprising a toothed drive pulley and a toothed output pulley, which are looped by a common toothed belt, which can be selectively lifted out of one of the pulleys in order to be able to rotate the pulleys independent from one another before coupling them again by means of the toothed belt.

According to a technically very elegant alternative, independent drive electromotors are provided for the first and the second crank drive. The speed of these electromotors can preferably be controlled. A synchronization means is associated to the two electromotors which guarantees a synchronous operation of the motors. An adjustable phase shift means is contained in the synchronization means. Signals from detectors are supplied to this phase shift means, said detectors detecting the rotary movement of the output shafts of the electromotors. The phase shift means serves to guarantee the synchronous operation of the electromotors by controlling at least one of the electromotors and to guarantee a predefined mutual time position of the detector signals of both output shafts. The rotary phase position of the output shaft of the one electromotor can be adjusted with respect to the rotary phase position of the output shaft of the other electromotor by adjusting the definition for the mutual time position of the detector signals. The phase adjustment of the crank drives is thus performed electrically in this solution. This alternative can most advantageously be realized if synchronous motors are used as drive motors, which are supplied by frequency variable alternating voltages. The synchronization means then has to comprise one adjustable phase shift means only.

The present invention was described by reference to a one-side needle loom, i.e. a needle loom in which the fleece is only needled from one side. The invention can also be applied for double-side needle looms. Double-side needle looms are looms in which needle bars are disposed in a needling unit at both sides of the fleece to be needled, and the needles stitch into the fleece either subsequently or simultaneously from both sides. A loom of this kind has been offered by the applicant by the name of Di-LOOM OUG-IL It contains four needle bars, which are disposed in pairs at both sides of the needling zone.

If in this loom the two needle bars of one pair opposite the fleece web to be needled on both sides work in push-pull operation, i.e. if the needles alternatingly penetrate into the fleece web from the top and from below, the time position of the horizontal movements, that are imposed onto the needle bars by their horizontal drive drives are also adjusted to work in push-pull operation in a manner that upon movement of the one needle bar by means of its vertical crank drive from an extreme position in the direction of the needling zone, its respective horizontal crank drive initially drives it in a direction opposite to the feed direction of the fleece web, whereas the other needle bar receives from its horizontal crank drive a movement component extending in the feed direction of the fleece web. In such a push-pull operation, it does not have to be taken care about a special disposition of the needles of the one needle bar with respect to the needles of the other needle bar of a needle bar pair, since a collision of needles is excluded. Two needles can be facing each other on the same axis.

If the needle bars of a pair are driven in synchronism, which is only possible if a mutual axial displacement of the needles of the one needle bar with respect to the needles of the other needle bar is maintained in order to avoid needle collisions, the horizontal crank drives are driven in synchronism. This is not only important to exclude distortions in the fleece but also avoids collisions of the needles and enables a high density of needles at the needle bars.

The axial offset of the needles or the upper needle bar(s) with respect to the needles or the lower needle bar(s) which is necessary in the latter mode of operation can be obtained by dividing the needle occupation pattern at the upper and lower needle bars with respect to a push-pull operation e.g. by disposing the needles in the upper portion and in the lower portion in a block with an original occupation density, but the upper and lower blocks are disposed in offset fashion, so that a slot in each of two stitching plates supporting the fleece, common for a plurality of needles of a block pair, is penetrated in its first half by the respective needles of the one block and in its second half by the respective needles of the other block. Or the upper and lower needle bars are put on gap, i.e. the odd numbered needle rows are assembled at the one needle bar and the even numbered needle rows are assembled at the opposite needle bar. Combinations of these solutions are also possible.

An alternative is to put the needles at the upper and lower needle bars on gap, i.e. to put the upper and lower needles on gap transversely to the fleece feed direction, i.e. a slot of each of the stitching plates is fully assigned to needles from the top, the slot neighbouring transversely to the fleece feed direction is fully assigned to needles from the bottom etc. over the entire working width.

A further alternative suggests to provide each slot somewhat broader than required for one needle row and to fully expose then from the top and from the bottom to needles by maintaining a small lateral offset of upper and lower needles. To assign or expose a slot to needles means that needles penetrating the slot are associated to the slot, said needles being disposed at the upper and lower needle bars.

The above-mentioned needle arrangements can also be used in double needle looms, the needle bars of which being driven in push-pull operation, and further in double needle looms that do not comprise a superimposed horizontal movement component of their needle bars.

Fleece feed lengths of 40 mm and even more per needle bar stroke can be obtained by the invention.

The invention will now be described under reference to the embodiments schematically shown in the drawings.

BRIEF DESCRIPTION OF THE DRAWINGS

FIG. 1*a* schematically shows a first embodiment of the invention. A needle bar is shown by block 1, which is adapted to carry a plurality of needles (not shown) on its bottom side, said needles being attached at a so-called needle board. The lower ends of two connecting rods 2 are pivotally attached at the top side of the needle bar 1, the upper ends (heads) of the connecting rods being rotatably supported on the eccentrics 3 of two crank shafts 4 that are driven in push-pull operation. The two crank shafts 4, eccentrics 3 and connecting rods 2 together form a first crank drive, which causes a reciprocating up and down movement of the needle bar 1 and thus the actual stitching movement of the needles into the fleece, which is not shown in this case and that has to be imagined to be lying horizontally below the needle bar 1.

Figure 1A:
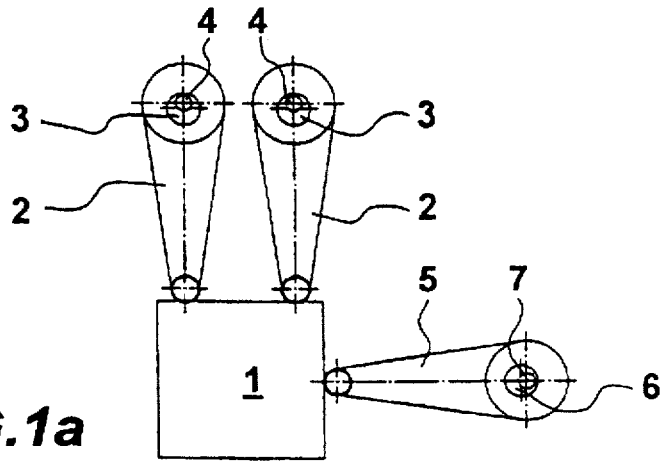
FIG. 1*a* to 1*d* schematically show four different embodiments of the invention, FIG. 2 diagrammatically shows the needling portion of a needle loom as a section of the needle loom and comprising the features of FIG. 1*a*.

A second connecting rod 5 extends transversely to the connecting rods 2 from the needle bar 1, the one end of the connecting rods 5 being pivotally attached at the needle bar 1 and the other end of which, i.e. its head being rotatably supported on the eccentric 6 of a crank shaft 7. The connecting rod 5, the eccentric 6 and the crank drive 7 together form a second crank drive, causing a reciprocating horizontal movement of the needle bar 1 parallel to the feed direction of the fleece (not shown).

It has to be mentioned that only one connecting rod 2 and 5 on the respective crank shaft 4 and 7 is shown in the drawing, but that owing to the longitudinal extension of the needle bar 1 a plurality of these connecting rods 2 and 5 are arranged in parallel on a respective common crank shaft, wherein these crank shafts are driven in phase with one another, i.e. the eccentrics of each crank shaft are equal to one another and are also aligned at the same angles.

Figure 2:
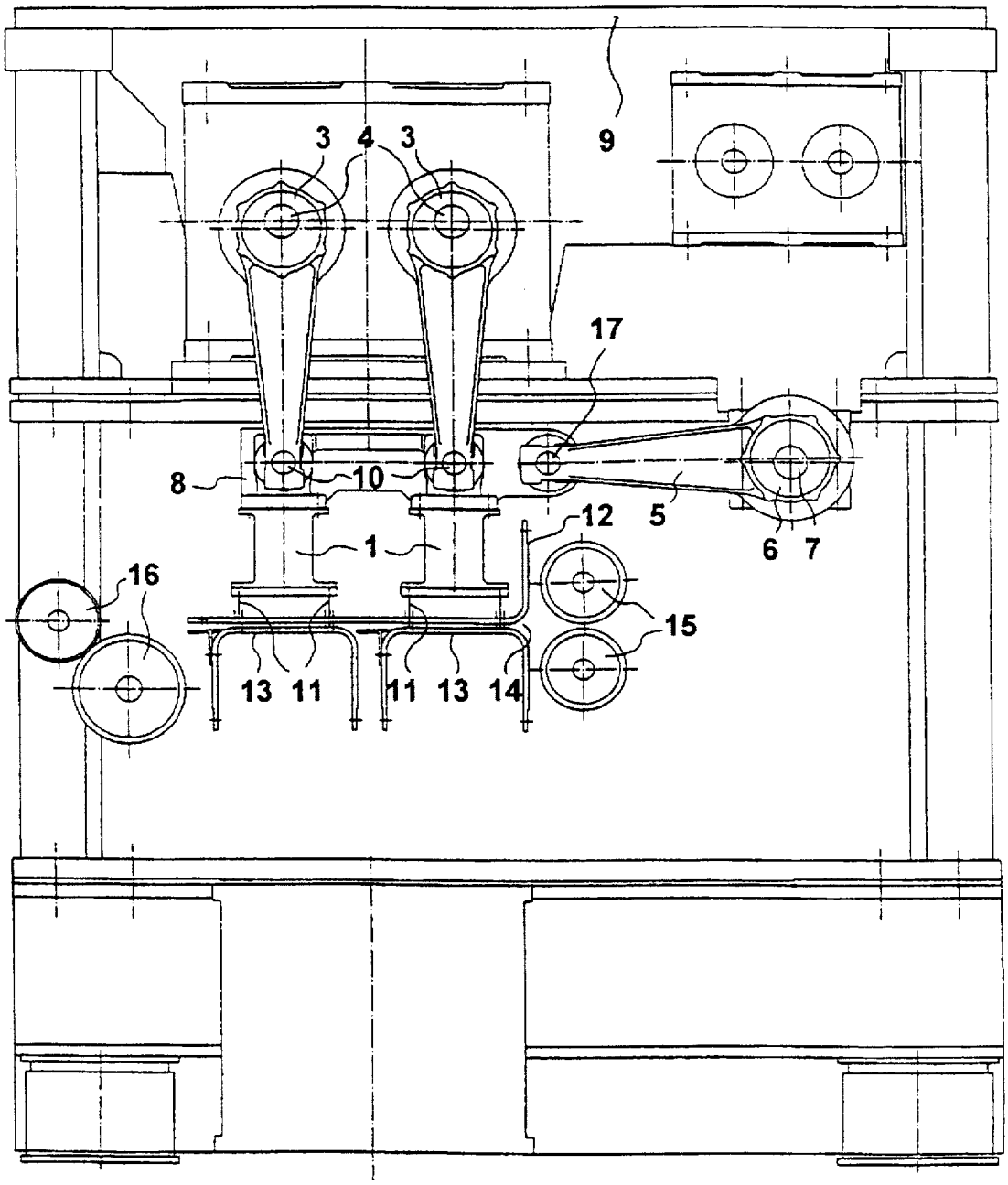

The drive schematically shown in FIG. 1*a* is shown in more detail in FIG. 2. A twin arrangement consisting of two needle bars 1 can be seen in FIG. 2 which are on the lower side connected at a console 8 at which two connecting rods are attached on the top side, the heads of which being rotatably supported in eccentrics 3 driven by the crank shafts 4. The crank shafts 4 are rotatably supported in a loom frame 9 and can be rotated by a drive (not shown). The pivotal connection of the connecting rods 2 with the console 8 is established by means of connecting pins 10.

Needle boards are attached at the bottom sides of the needle bars 1, said needle boards carrying needles 11, wherein only a few needles are shown due to reasons of clarity. A holding-down means 12 and stitching plates 13 are disposed underneath the needle bars 1, said holding-down means and said stitching plates being disposed at mutual distance to each other forming a gap 14. The gap 14 fanned between the holding-down means and the stitching plates receives the fleece web to be needled (not shown), conveyed through the gap by feed rollers 15 upstream the gap 14 and output rollers 16 downstream the gap 14 to be subjected to a needling in the gap 14. The holding-down means 12 and the stitching plates 13 are provided with elongated slots for penetration by the needles, owing to a reason that will be explained later, wherein the longitudinal extension of these slots extends in the feed direction of the fleece, from right to left in the drawing.

The one end of a connecting rod 5 is laterally linked to the console 8 by means of a connecting pin 17, the head of the connecting rod 5 at the other end being rotatably supported on an eccentric, which is attached on a crank shaft 7 which is rotatably supported in the loom frame 9 and which can be rotated by a drive means (not shown). A compensatory shaft arrangement 24 disposed above the crank shaft 7 in the loom frame 9 driven synchronously with the crank shaft 7 is adapted to dynamically balance the vibrations caused by the crank shaft.

It is once more pointed to the fact that only one connecting rod 5 is shown in the drawing but that a plurality of connecting rods are linked in parallel to the console 8 due to the longitudinal extension of the needle bars 1, the connecting rods being spaced longitudinally of the needle bars and the eccentrics 6 of their associated crank shaft 7 being in phase and act at the same stroke. The connecting rod 5, the eccentric 6, the crank drive 7 and the connecting pin 17 together form a second crank drive, which is defined and able to provide the console 8 and the needle bar 1 attached thereto with an oscillating movement component in the horizontal direction, i.e. in the drawing from right to left and from left to right.

The first crank drive, consisting of the connecting rods 2, eccentrics 3, crank shafts 4 and connecting pins 10, and the second crank drive, consisting of the connecting rods 5, eccentrics 6, crank shaft 7 and connecting pins 17 are driven at the same speed and effect that during operation of the needle loom, the console 8 with the needle bar 1 attached thereto is moved on a closed path, which according to the amount of the eccentricities of the eccentrics 3 and 6 is circular or elliptic, wherein the plane of this superimposed movements extends perpendicularly to the longitudinal extension of the needle bars 1. The phase positions of the rotary movements of the crank shafts 4 and 7 are balanced to one another in a manner that upon downward movement of the needle bar 1, a movement of the same in feed direction of the fleece is carried out (in FIG. 2 from right to left) so that in the condition in which the needles 11 are stitched into the fleece, the feed of the fleece is not distorted by the needles. This horizontal movement is also prevailing during a portion of the upward movement of the needle bars 1, whereas the horizontal return movement of the needle bars 1 takes place at a time during which the tips of the needles 11 have left the fleece.

Figure 1B:
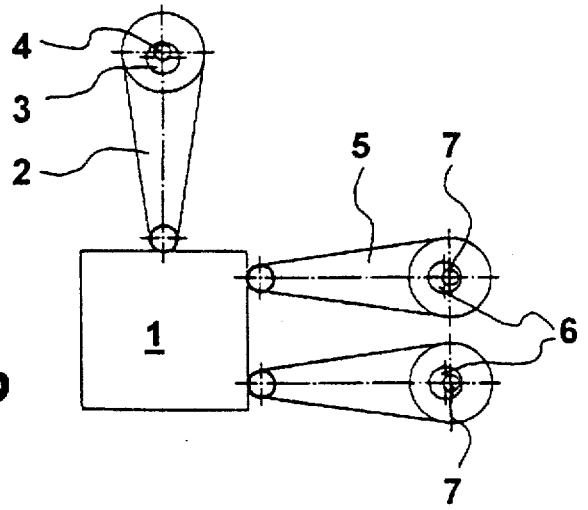
Figure 3:
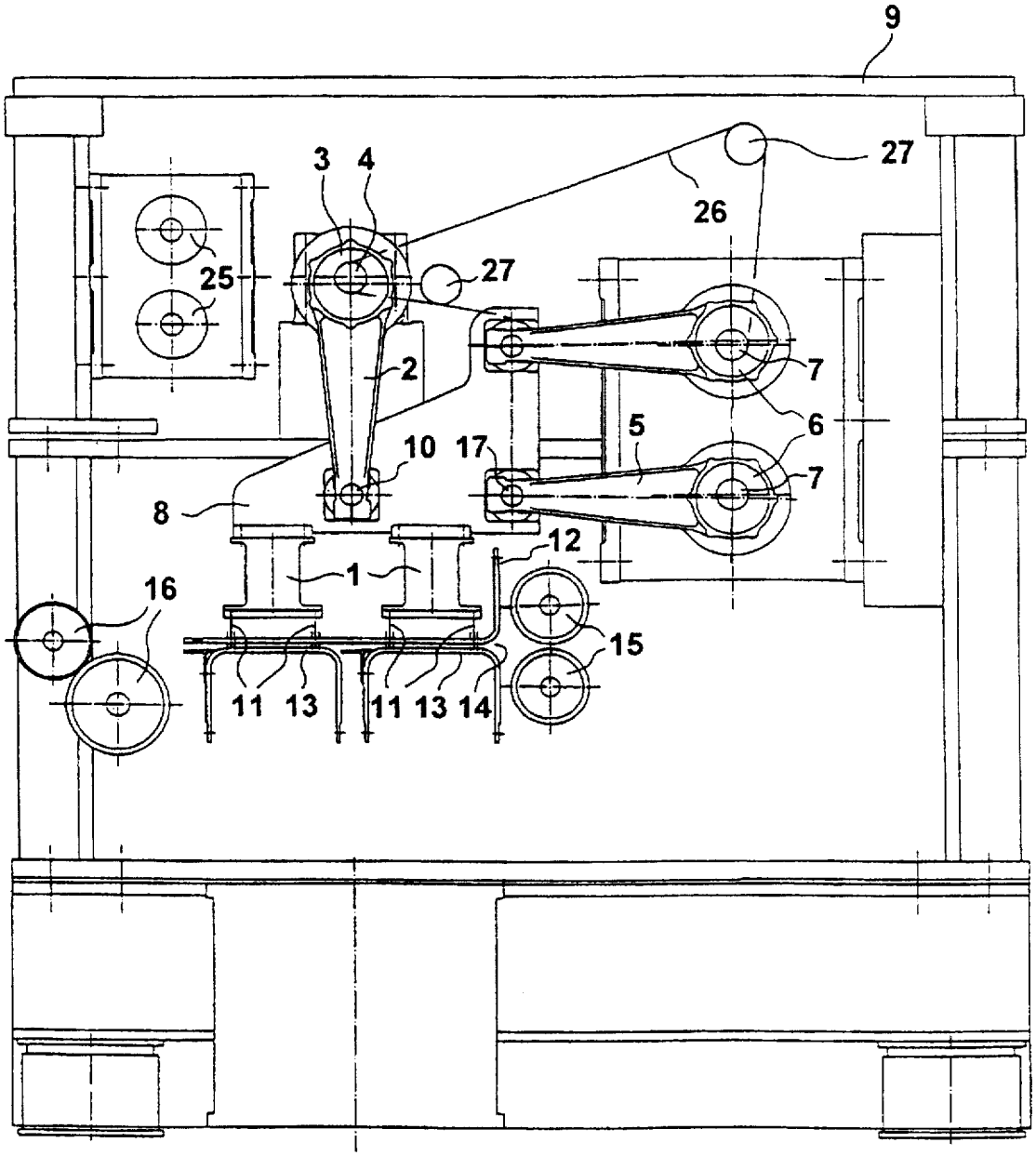
FIG. 3 shows the needling portion of the loom as a section of a needle loom comprising the features of FIG. 1B.

FIG. 3 shows an embodiment of the invention, which corresponds to the principle of FIG. 1B. The first crank drive comprises one crank shaft only, on which eccentrics 3 are disposed, on which connecting rods 2 are rotatably supported, which are attached at the console 8 by means of connecting pins 10. A compensation shaft arrangement 25 disposed adjacent the crank shaft 4 in the loom frame 9 is adapted to dynamically balance the vibrations caused by the crank shaft 4. The drawing shows one connecting rod 2 only, even though it has to be emphasized that at least two of these connecting rods 2 with their associated eccentrics 3 are supported in a common crank shaft 4. Two needle bars 1 that are parallel to one another are attached at the bottom side of the console 8. These needle bars, their needles 11, holding down means 12, stitching plates 13, gap 14, feed rollers 15 and output rollers 16 correspond to the arrangement of FIG. 2 and do not need to be explained again.

In contrast to the embodiment according to FIG. 2, the second crank drive in the embodiment according to FIG. 3 includes a twin arrangement consisting of two crank shafts 7 disposed on top of each other, having eccentrics 6 and connecting rods 5, which are attached at two locations at the console 8 on top of each other by means of connecting pins 17. The crank shafts 7 are preferably driven in opposite directions, the eccentrics 6 thereof then being offset to one another by 180°. They may also be driven in the same directions, if the necessary mass balance is taken over by special means, such as compensation shafts (not shown). In the latter case, the eccentrics are oriented in the same direction.

As is the case in the example according to FIG. 2, the console 8 is put into motion by the first and second crank drives, consisting on one hand of the crank shaft 5,the eccentric 3, the connecting rods 2 and the connecting pin 10 and on the other hand consisting of the crank shafts 7, the eccentrics 6, the connecting rods 5 and the connecting pins 17, said console 8 following a closed path which may be circular or elliptic according to the eccentricities of the eccentrics 3 and 6, so that the needle bars 1 perform a respective movement by means of which the needles 11 are stitched into the fleece disposed in the gap if the needle bars 1 move from right to left, i.e. in the fleece feed direction.

Figure 1C:
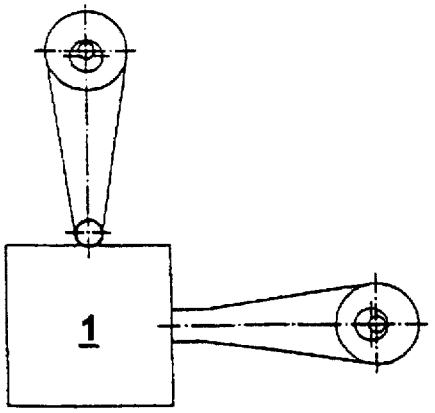
Figure 1D:
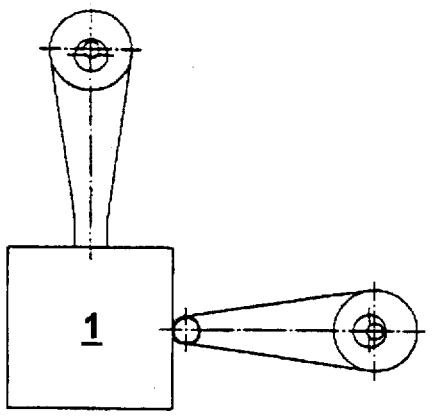

Embodiments for the drive of the needle bar that have a simpler design are imaginable according To FIG. 1*c* and 1*d*. The person skilled in the art knows how to make the embodiments according to FIG. 2 and 5 more simple to realize the embodiments according to FIG. 1*c* and 1*d*, so that a detailed description by detailed drawings is not necessary.

FIG. 3 also shows a mechanical solution for the mutual synchronization of the drive of the two crank drives one of which being driven by a motor (not shown). This solution is characterized by a toothed belt 26, which encloses toothed belt pulleys fixed for co-rotation on the crank shafts 4 and 7. The toothed belt 26 is guided in the example that is shown by at least two idling rollers 27, one of The idling rollers being disposed in the path of The approaching belt section and the other idling roller being disposed in the path of the returning section of the toothed belt 26. If one of the idling rollers 27 is adjusted in a manner that the associated section of the toothed belt 26 becomes longer, and as a compensation measure the other idling roller 27 is adjusted in a manner that the associated section of the toothed belt 26 becomes shorter this results in a change of the relative rotary phase position of the crank drives, without the toothed belt being released from the toothed belt pulleys attached on the crank shafts 4 and 7 or without releasable clutch elements having to be provided.

Figure 4:
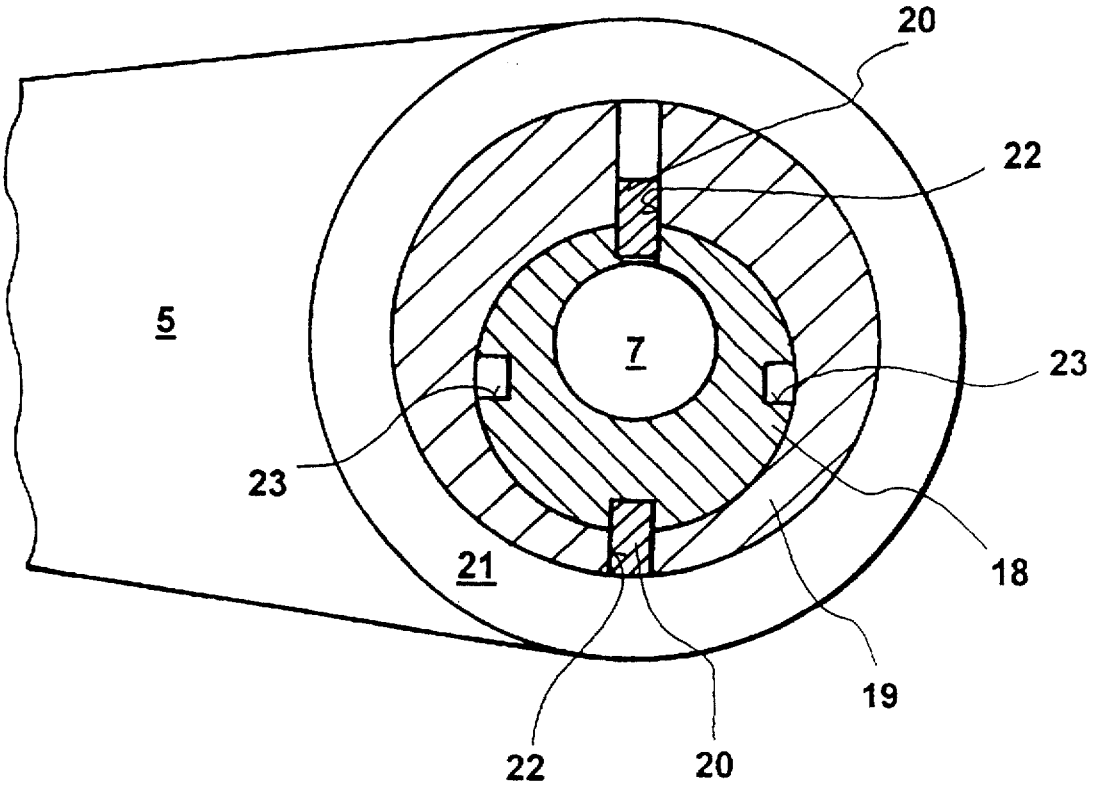
FIG. 4 shows as a detail an adjustable eccentric means.

FIG. 4 shows as a detail an eccentric arrangement for a connecting rod 5 of the second crank drive. This eccentric arrangement has an eccentric pin 18 fixedly connected to the crank shaft 7 and an eccentric bushing 19 disposed on the eccentric pin 18 and fixable in different rotary positions with respect to the eccentric pin 18 by means of bolts 20. The eccentric pins 18 and the eccentric bushing 19 together form the second eccentric 6. The head 20 of the connecting rod 5 is rotatably supported on the eccentric bushing 19. The bolts 20 are releasably inserted into bores 22 in the eccentric bushing 19 and bores 23 in the eccentric pin 18, wherein in the present case, the eccentric pin 18 has a greater number of these bores 23 than bushing 19. The effective eccentricity of the second eccentric 6 and thus the stroke of the horizontal movement performed by the needle bars 1 can be changed by a rotary adjustment of the eccentric bushing 19 with respect to the eccentric pin 18 and the coupling of these elements by means of the bolts 20 in selected mutual rotary positions. The adjustment of the eccentricity is performed in the present example in that the bolts 20 are pulled out of the bores 22 to such an extent that they get released from the bores 23 in the eccentric pin 18. The eccentric pin 18 may then be rotated with respect to the eccentric bushing 19 and may then be rigidly connected to the eccentric bushing 19 by inserting the bolts 20 in a different bore 23 in the eccentric pin 18. To facilitate the mutual rotation of the eccentric pin 18 and the eccentric bushing 19, the head 21 of the connecting rod 5 may temporarily be fixed for co-rotation with the eccentric bushing 19 by means of equivalent coupling devices (not shown). If the bolts 20 are released, the eccentric pin can be brought in a rotary position by rotating the crank shaft 7 of the eccentric pins that corresponds to the desired size of the eccentricity of the second eccentric 6 to be adjusted.

For moving the bolts for releasing and re-establishing the connections of the respective components created thereby, hydraulic or pneumatic means can be used as they are common for comparable purposes in the construction of presses. A detailed description will not be made.

Figure 5:
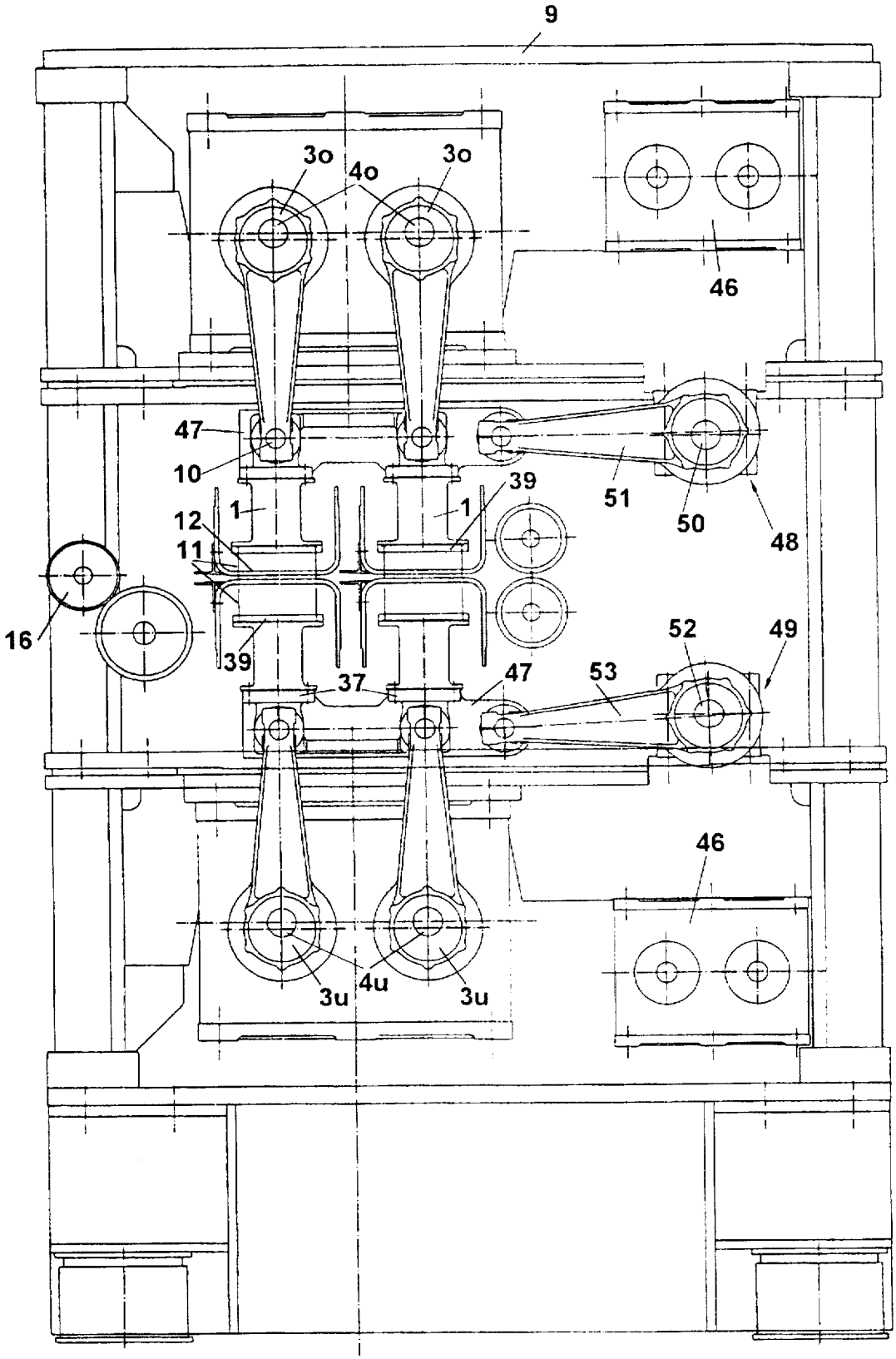
FIG. 5 shows a diagrammatical side view of a double needle loom comprising the features of the invention.

FIG. 5 diagrammatically shows the essential elements of a double needle loom in a twin arrangement. The needle loom comprises a frame 9, with two upper vertical crank drives **3*o*, 4*o* being disposed in the upper section thereof and with two lower vertical crank drives 3*u*, 4*u* being disposed in the lower section thereof. Each crank drive comprises a crank shaft 4*o* or 4*u* having a eccentric 3*o* or 3*u* and a connecting rod, which is on one end driven by the eccentrics and which is on the other end pivotally connected to the upper and lower needle bar carriers 36 and 37, respectively. Needle bars 1 are attached at the needle bar carriers 36 and 37, said needle bars 1 carrying the needle boards 39 that are equipped with the needles 11, with only a few needles being shown. The needles 11 penetrate into stitching plates 12, in which slots 42 are formed (see FIG. 3) that extend in the feed direction of the fiber batt to be needled (not shown). One needling zone each is located between two opposing stitching plates 12, through which needling zones the fiber batt to be needled is passed. Feed and output rollers 15 and 16 serve for supplying and discharging his fiber batt. A compensation shaft arrangement 46 for the mass compensation of the vertically moving masses of eccentrics, connecting rods and parts connected herewith can be further seen in the upper and lower section of the frame 9. Furthermore, it has to be remarked that the upper and lower needle bar carriers 36 and 37 are rigidly connected to one another by means of connectors 47**.

In this respect the construction that is described is conventional. It differs from the construction according to FIG. 2 in that the holding-down means of FIG. 2 is to be replaced by a second stitching plate 12.

According to the invention, an upper horizontal crank drive 48 and a lower horizontal crank drive 49 are associated to the upper and lower needle bars 1. The upper horizontal crank drive 48 consists of an eccentric 50 which drives an upper connecting rod 51, the end distant to the eccentric 50 being connected to the connector 47 of the upper needle bar carrier 36, whereas the lower horizontal crank drive 49 consists of a lower eccentric 52 with a lower connecting rod 53 guided thereon, the end distant to the eccentric 52 being connected to the connector 47 of the lower needle bar carrier 37. Drive means for the crank drives 48 and 49 are not shown due to reasons of clarity.

As can be seen from FIG. 5 by means of the shown positions of the upper and lower eccentrics **3*o* and 3*u*, the vertical crank drives are driven in push-pull operation. Accordingly, the upper needle bars 1 take their lower end position, if the lower needle bars 1 are in their lower end position, i.e. the needles 11 at the upper needle boards 39 are stitched into the fiber batt (not shown), while the needles 11 at the lower needle boards 39 are completely pulled out the fiber batt. It can further be seen from the position of the upper and lower eccentrics 50 and 52 of the horizontal crank drives 48 and 49 that the rotary angle positions are offset to one another by 180°. The sense of this measure is explained under reference to FIG. 6*a* and 6*d***.

Figure 6A:
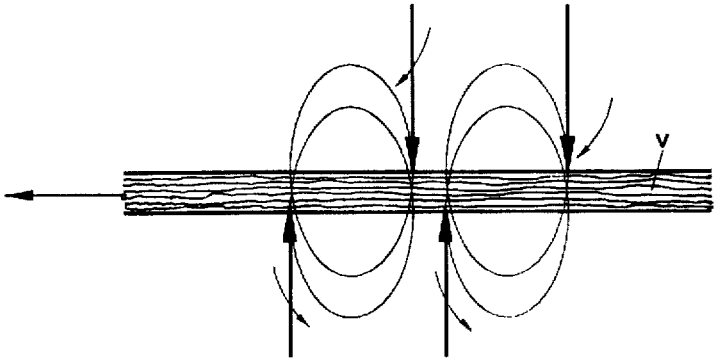
FIGS. 6*a*–6*d* are diagrammatical views of the motion paths of the needle tips of a double needle loom, the upper and lower needle bars being driven in push-pull operation.
Figure 6B:
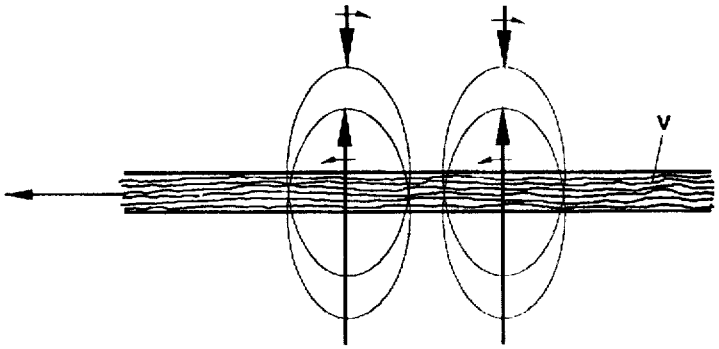
Figure 6C:
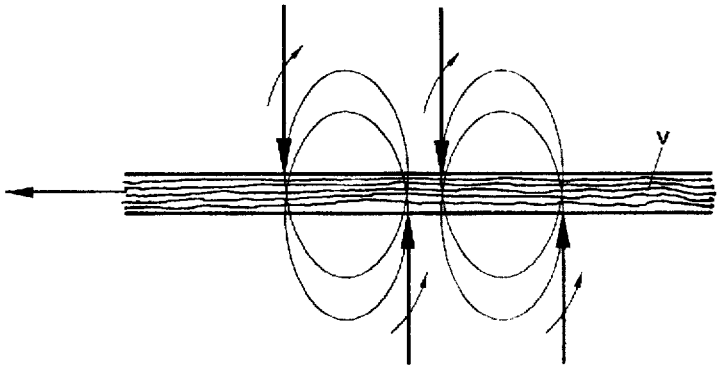
Figure 6D:
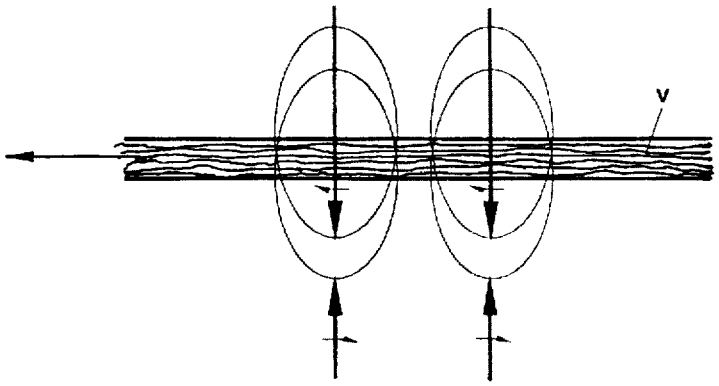

FIG. 6A shows the condition corresponding to FIG. 5, in which the needles 11 attached to the lower needle boards 39, hereinafter termed as "upper" needles are stitched into the fiber batt V at a maximum, the "lower" needles however, not having any contact to the fiber batt V. During the subsequent partial cycle of the movement of the vertical crank drive, the upper needles are pulled out of the fiber batt V, while the "lower" needles are moved to the fiber batt. As can be seen in the condition shown in FIG. 6B, the "upper"needles were moved extremely to the left, i.e. in the feed direction of the fiber batt, whereas the "lower" needles were moved in the direction opposite to the feed direction of the fiber batt extremely to the right. In the following partial cycle of the movement, the end of which being shown in FIG. 6C, the lower needles stitched into the fiber batt V are moved in the feed direction of the fiber batt, whereas the upper needles are moved opposite to this feed direction. These last mentioned movement components in the horizontal direction last until the end of the fourth partial cycle shown in FIG. 6D, where the lower needles leave the fiber batt V and the upper needles start to stitch into the fiber batt V. Subsequently, the upper and the lower needles are moved back to the positions shown in FIG. 6A. In the condition in which the needles are stitched into the fiber batt V, the needles 10 also perform the horizontal movement thereof.

Due to the opposite directions of the movements of the needle bars in the horizontal direction, a mass compensation of the needles in the horizontal direction is given in an advantageous manner.

Figure 7:
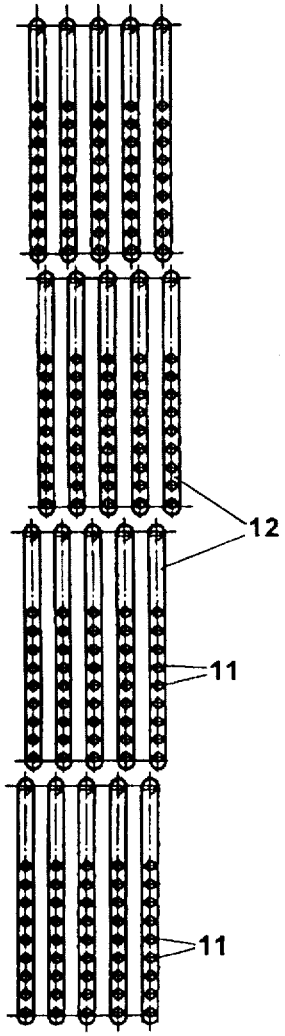
FIG. 7 is a schematical partial view of the needle arrangement at upper and lower needle bars of a needle loom working in push-pull operation, with its needle penetration slots in the respective slot pulleys.

Since in the event of push-pull operation according to the above-mentioned embodiment, the needles 11 cannot collide with one another, it is possible to equip the upper and the lower needle boards with needles identically, wherein the needles may possibly also be provided in the same axis. Such a needle pattern is shown in FIG. 7. FIG. 7 shows a section of a stitching plate 12. One group of needles 11 each has associated thereto a common slot 42 extending in the fleece feed direction, said slot having a certain over-length, to comply with the movement component of the needle bars extending horizontally in the fleece feed direction. It can be seen in FIG. 7 that the slots are laterally offset to one another in the fleece feed direction of subsequent needle groups to receive a regular needling of the fiber batt without the generation of stripes.

Figure 8A:
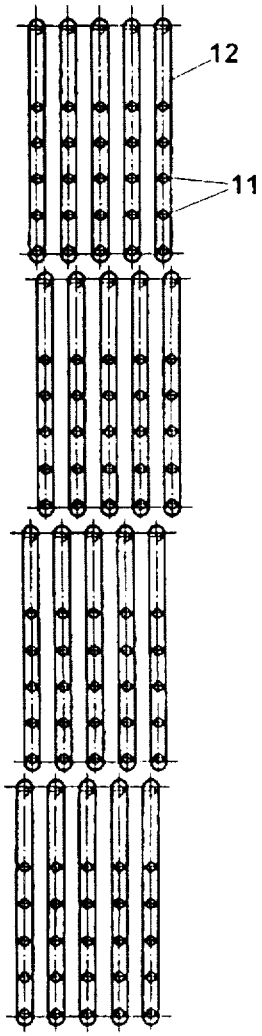
FIG. 8*a* and 8*b* show a schematical partial view of the needle arrangements at upper and lower needle bars with a needle loom working in push-pull operation with its needle penetration slots in the respective slot pulleys, according to another embodiment of the invention.
Figure 8B:
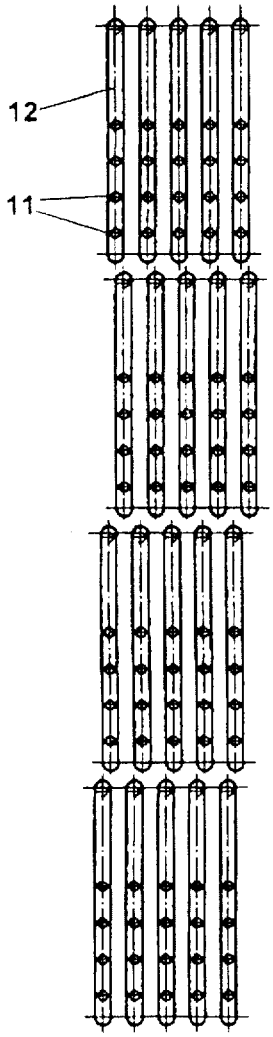

It is also possible to operate the vertical crank drives in common mode so that the needles carried by the needle boards penetrate the fiber batt simultaneously from both sides. In this case it has to be taken care that the upper and lower needles do not collide with one another. Suitable needle patterns are shown in FIG. 8A and 8*b*, FIG. 8A showing the needle mounting pattern at the lower needle boards and FIG. 8B showing the needle mounting pattern at the upper needle boards. As can be learned from a comparison of FIG. 8A with FIG. 8B, the needles 11 of the upper needle boards are offset about half a needle pitch with respect to the needles 11 of the lower needle boards seen in fleece feed direction.

During operation, the upper needles penetrate the slots 42 of the lower stitching plate at positions located between the lower needles, whereas the needles of the lower needle boards penetrate the slots of the upper stitching plate at positions located between the upper needles. This leads to an intimate felting of the fiber batt. It can also be seen that in the embodiment according to FIG. 8A and 8b the needle density at each needle board is approximately half as great as the needle density in the embodiment according to FIG. 7.

Finally, it has to be mentioned that for achieving a mass compensation, the vertical crank drives 2 or 3 adjacent to one another are advantageously driven in directions opposite to one another. In case of upper and lower needle bars that are driven in common mode, the horizontal crank drives are most purposefully also driven in opposite directions.

We claim:

1. In a needle loom including a needle bar drive and a needle bar for processing a fiber batt moved by a conveying means in a predetermined feed direction through the needle loom, the improvement comprising at least one first crank drive for generating a first reciprocating movement of a needle bar, said reciprocating movement extending substantially vertically to the fiber batt to be processed, a guide means which laterally guides the needle bar on its path of movement, wherein said guide means is formed by at least one second crank drive comprising at least one connecting rod attached to the needle bar and providing said needle bar with a second reciprocating movement extending parallel to the feed direction of the fiber batt, and means for establishing a synchronism of the movements generated by said first and second crank drives.

2. A needle loom according to claim 1, wherein the first crank drive is formed of a twin arrangement comprising two synchronously and in-phase rotating crank shafts having respective eccentrics and associated connecting rods, and wherein the connecting rod of the second crank drive is pivotally connected to the needle bar.

3. A needle loom according to claim 1, wherein the needle bar is put into the first reciprocating movement extending vertical to the fiber batt by a single crank drive having a connecting rod that is pivotally connected to the needle bar, and wherein two second crank drives are provided, having connecting rods which are attached at the needle bar at different locations, that have a distance from one another seen in the direction of the first reciprocating movement of the needle bar.

4. A needle loom according to claim 1, wherein the needle bar is put into the first reciprocating movement extending vertical to the fiber batt by means of a single crank drive having a connecting rod, which is pivotally connected to the needle bar, and wherein the second crank drive comprises a connecting rod, having one end which is rigidly connected to the needle bar.

5. A needle loom according to claim 1, wherein the needle bar is put into the first reciprocating movement extending vertical to the fiber batt by means of a single crank drive having a connecting rod which is rigidly connected to the needle bar, and wherein the second crank drive comprises a connecting rod having one end which is pivotally connected to the needle bar.

6. A needle loom according to any one of the preceding claims, wherein means are provided, by which a phase of the second reciprocating movement component generated by the second crank drive is adjustable with respect to a phase of the first reciprocating movement of the first crank drive.

7. A needle loom according to claim 6, wherein the drive shafts of the first crank drive and the second crank drive are connected to one another through an intermediate gearing, which comprises adjustable means for changing a phase relation between the drive shafts of the crank drives.

8. A needle loom according to claim 7, wherein the intermediate gearing comprises a toothed belt, which loops around toothed belt pulleys attached on the drive shafts of the crank drives.

9. A needle loom according to claim 8, wherein said toothed belt comprises two sections extending between said pulleys and wherein at least one adjustable idling roller is coupled with each said belt sections, wherein a length of said belt sections can be changed by displacing said idling rollers transversely to said belt sections.

10. A needle loom according to claim 7, wherein the intermediate gearing comprises a toothed belt, which loops around a drive pulley and an output pulley and which can be selectively disengaged with respect to one of these pulleys.

11. A needle loom according to claim 7, wherein the intermediate gearing comprises a selectively engageable and disengageable clutch, having drive and output elements that can be engaged with one another in different mutual rotary positions.

12. A needle loom according to any one of claims 1 to 5, wherein the first and second crank drives are driven by electromotors that are independent from one another and wherein a synchronization means is coupled with the electromotors, said synchronization means ensuring a synchronous operation of the electromotors, and wherein a phase shift means is provided, by means of which by influencing at least one electromotor, a rotary phase of an output shaft of the one electromotor is adjustable with respect to a rotary phase of an output shaft of the other electromotor.

13. A needle loom according to claim 12, wherein the electromotors are synchronous motors, which are supplied with a frequency-variable alternating voltage.

14. A needle loom according to any one of claims 1 to 5, wherein the second crank drive(s) has (have) a stroke length that is adjustable proportionally to a stroke length of the first crank drive.

15. A needle loom according to any one of claims 1 to 5, wherein the stroke length of the second crank drive (s) has (have) a stroke length that is adjustable independent from a stroke length of the first crank drive.

16. A needle loom according to any one of claims 1 to 5, wherein the second crank drive(s) comprise(s) an eccentric pin disposed on a crank shaft, with an eccentric bushing being disposed in the eccentric pin on which a head of the connecting rod of the second crank drive is rotatable supported, and wherein said eccentric pin and said eccentric bushing can be fixedly coupled with one another in different mutual rotary positions for adjusting a stroke length of the second crank drive.

17. A needle loom according to any one of claims 1 to 5 comprising at least one needling zone and a pair of needle bars disposed on two sides of the needling zone, said needle bars each carrying a plurality of needles directed against the needling zone and being driven by a first crank drive in oscillating vertical movements directed against the needling zone and away from it, to stitch the needles into the fiber bate located in the needling zone, and means for establishing a synchronism of the vertical movements of the needle bars of said pair in a manner that said first crank drives have circular frequencies which are offset to one another by 180° wherein a second crank drive is connected to each needle bar, said second crank drives providing the needle bars each with a reciprocal horizontal movement directed parallel to the feed direction of the fiber batt in the needling zone, said horizontal movements being in synchronism with the vertical movements of the needle bars, and wherein the second crank drives have circular frequencies which are offset to one another by 180° in a manner that upon movement of the one needle bar by means of its first crank drive from an extreme position in the direction towards the needling zone its associated second crank drive initially drives it in a movement directed opposite the feed direction of the fiber bats, whereas the other needle bar receives from its associated second crank drive at the same time a movement extending in the transport direction of the fiber bats.

18. A needle loom according to any one of claims 1 to 5 comprising at least one needling zone and a pair of needle bars disposed on two sides of the needling zone, said needle bars each carrying a plurality of needles directed against the needling zone and being driven by a first crank drive in oscillating vertical movements directed against the needling zone and away from it, to stitch the needles into the fiber batt located in the needling zone, and means for establishing a synchronism of the vertical movements of the needle bars of said pair in a manner that the needles of both needle bars of the pair stitch into the fiber batt at the same time wherein a second crank drive is connected needle bar, said second crank drive providing the needle bars with a reciprocal horizontal movement directed parallel to the feed direction of the fiber batt in the needling zone, said horizontal movement being in synchronism with the vertical movements of the needle bars, and wherein the two second crank drives are driven mutually in phase, wherein an assembly of needles of needle boards attached at the needle bars are disposed in a manner that axes of the needles of the one needle bar are offset with respect to axes of the needles of the other needle bar, wherein the mutual timing of the crank movements of the second and first crank drives is performed in a manner that upon movement of the needle bars by means of the first crank drives from an extreme position in the direction towards the needling zone, the second crank drives provide the needle bars with a reciprocating movement initially extending opposite the feed direction and later extending in the feed direction of the fiber bats.

19. A needle loom according to claim 17, wherein seen in the fiber bath feed direction, two needling zones are disposed at a close distance to one another, with the needle bars adjacent to one another being rigidly connected to one another, wherein the vertical crank drives associated thereto rotate in opposite directions.

20. A needle loom according to claim 18, wherein seen in the fiber bath feed direction, two needling zones are disposed at a close distance to one another, with the needle bars adjacent to one another being rigidly connected to one another, wherein the vertical crank drives associated thereto rotate in opposite directions.

* * * * *